US005341680A

United States Patent [19]

Smart et al.

[11] Patent Number: 5,341,680

[45] Date of Patent: Aug. 30, 1994

[54] DISABLED DRIVER ASSESSMENT SYSTEM

[75] Inventors: Edwin D. Smart, Marion; Julie N. Dezern, Asheville; William B. Pendleton, Winston-Salem; Kenneth C. Pearson, Greenville; Allison M. Blui, Cary; James R. Machen; David E. Mehaffey, both of Charlotte; Edmund H. Machen, Charlotte; Edgar B. Montague, Charlotte, all of N.C.

[73] Assignee: NC Dept. of Human Resources, Division of Vocational Rehabilitation Services, Raleigh, N.C.

[21] Appl. No.: 127,989

[22] Filed: Sep. 27, 1993

Related U.S. Application Data

[63] Continuation of Ser. No. 752,862, Aug. 30, 1991, abandoned.

[51] Int. Cl.[5] ..... A61B 5/22

[52] U.S. Cl. ..... 73/379.06; 73/379.08; 73/865.4

[58] Field of Search ..... 73/379.08, 379.06, 865.4; 128/782; 434/62, 64, 65

[56] References Cited

U.S. PATENT DOCUMENTS

| | | | |
|---|---|---|---|
| 4,233,844 | 11/1980 | Dreisinger et al. | 73/379 |
| 4,471,957 | 9/1984 | Engalicheff, Jr. | 73/379 |
| 5,031,912 | 7/1991 | Vaughn et al. | 482/118 |

*Primary Examiner*—Hezron E. Williams
*Assistant Examiner*—Nashmiya N. Ashraf
*Attorney, Agent, or Firm*—Richard E. Jenkins

[57] ABSTRACT

A driver measure system aids in determining the physical requirements of a disabled driver in order to modify a van or other vehicle to his or her specific needs. The driver measurement system comprises a frame including tracks for positioning a wheelchair and a control assembly which includes a steering wheel and hand controls. Force adjustment and measurement mechanisms for the steering wheel and hand controls enables a trained technician to evaluate the functional driving ability of the disabled driver. The simulator also provides a structural reference framework for taking anthropometric measurements. The measurements obtained are used to prepare a specification or "mobility prescription" for modifications and adaptive driving equipment needed to customize a vehicle.

15 Claims, 5 Drawing Sheets

DISABLED DRIVER ASSESSMENT SYSTEM

This Application is a Continuation of Prior Application Ser. No. 07/752,862, filed Aug. 30, 1991, now abandoned.

TECHNICAL FIELD

The present invention relates generally to the field of testing equipment for testing functional ability of a disabled person and more particularly to a testing device for evaluating the functional driving ability of a disabled driver.

RELATED ART

Many disabled persons who have lost use of their legs are still able to drive vehicles which are specially modified to meet the specific needs of the disabled driver. To make the necessary modifications, a rehabilitation technician must prescribe the precise modifications and adaptive driving equipment for the driver. The prescription is generally incorporated into a bid request for distribution to vendors for quotations on customizing a vehicle for a disabled client. It is essential that the specific structural modifications and adaptive equipment be accurately prescribed prior to initiating costly modifications to the vehicle.

Driver testing and training apparatuses are known for testing the driving ability of non-disabled drivers. Two such systems are described in U.S. Pat. No. 3,594,921 to Quicker, Jr. and U.S. Pat. No. 2,979,831 to Bullock. Both of these patents disclose an apparatus for simulating predetermined driving conditions as well as means for measuring the reaction of the driver to certain events. Neither of these devices are useful for testing the driving abilities of a disabled driver or for prescribing vehicle modifications and adaptive driving equipment to meet the specific needs of the disabled driver.

There are also various medical diagnostic devices for muscular evaluation and for measuring human motor control. Exemplary medical diagnostic devices are disclosed in U.S. Pat. No. 4,885,687 to Cary, U.S. Pat. No. 4,416,293 to Anderson et al., and U.S. Pat. No. 3,752,144 to Weigle Jr. None of these devices are useful for evaluating the driving ability of a disabled driver or for preparing a "mobility prescription".

DISCLOSURE OF THE INVENTION

The present invention is a driver measurement system which enables a rehabilitation technician to accurately prescribe the structural modifications and adaptive driving equipment needed to customize a vehicle for a particular disabled driver. The driver measurement system uses a simulator having steering controls and hand controls to help evaluate functional driving ability. The simulator includes force adjustment and measurement mechanisms for the steering controls and hand controls. The simulator also provides a structural reference framework for taking anthropometric measurements. The measurements obtained are used to select or recommend specific modifications and adaptive driving equipment for the subject. This "mobility prescription" can be incorporated into bid requests and distributed to vendors for quotations on customizing a vehicle for the subject.

Accordingly, it is a primary object of the present invention to provide a driver measurement system which enables the rehabilitation expert to more accurately prescribe structural modifications and adaptive driving equipment needed to customize a vehicle for a particular disabled driver.

Another object of the present invention is to provide a driver measurement system for assessing driving ability of a disabled driver which can be easily disassembled and transported.

Another object of the present invention is to provide a driver measurement system which will measure position, operational range, size, and force requirements for steering, brake and throttle controls.

Yet another object of the present invention is to provide a driver assessment system which will provide standard and accurate data for use on a national basis.

Other objects and advantages of the present invention will become apparent and obvious from a study of the following description and the accompanying drawings which are merely illustrative of such invention.

BEST MODE FOR CARRYING OUT THE INVENTION

Figure 1:
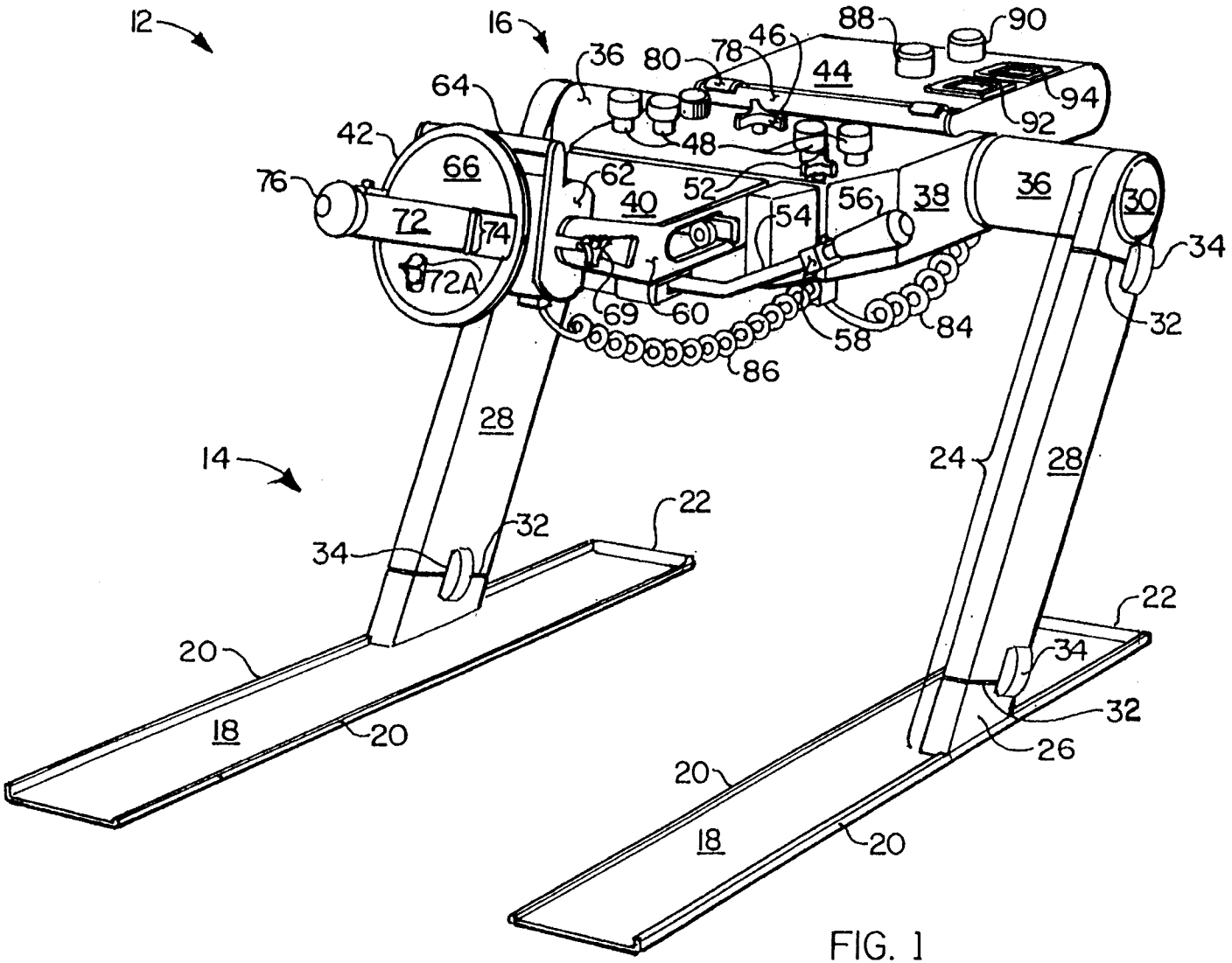
FIG. 1 is a perspective view of the disabled driver assessment system of the present invention.
Figure 2:
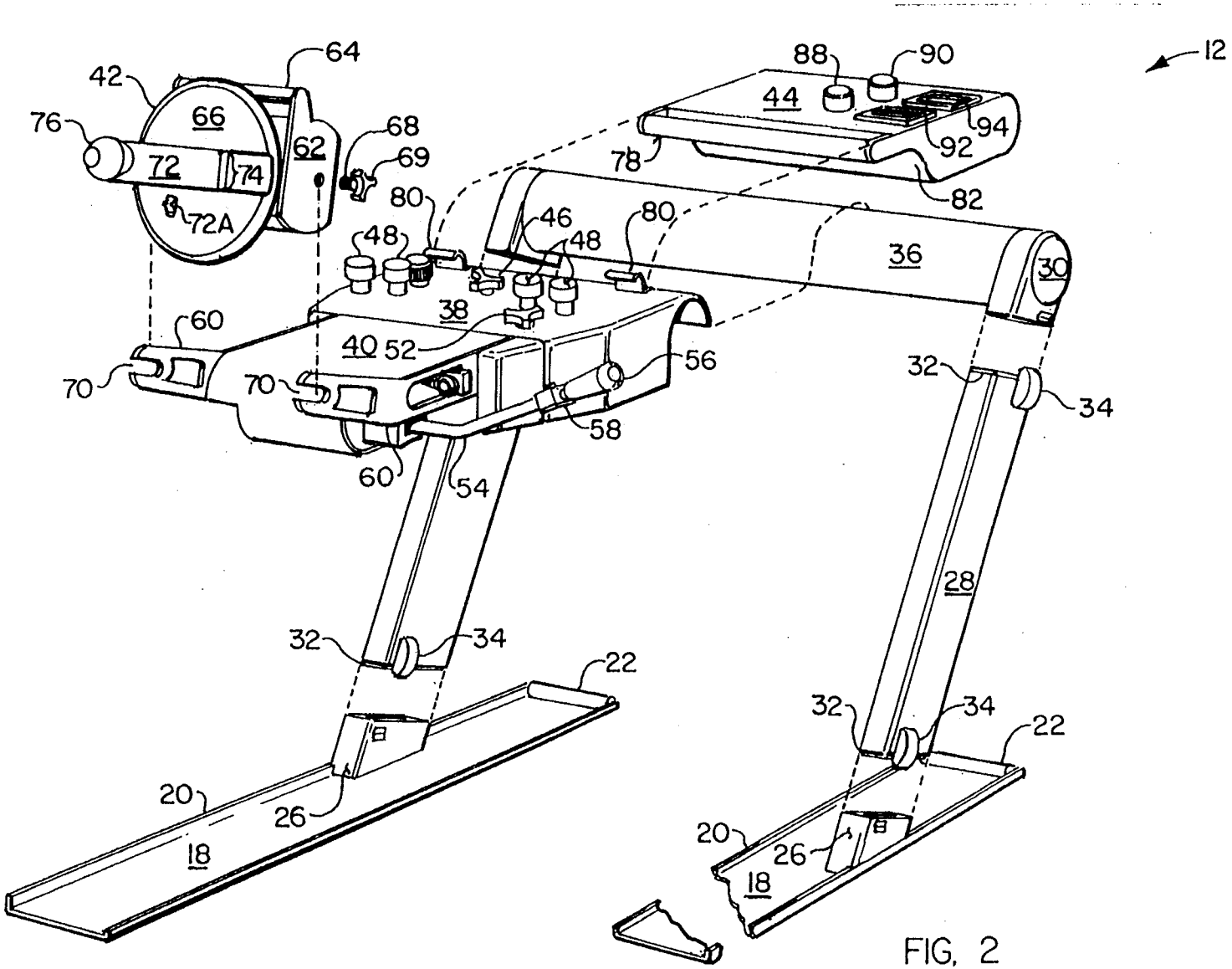
FIG. 2 is an exploded perspective view illustrating how the modular components of the disabled driver assessment system are assembled and disassembled for transporting from site to site.
Figure 3:
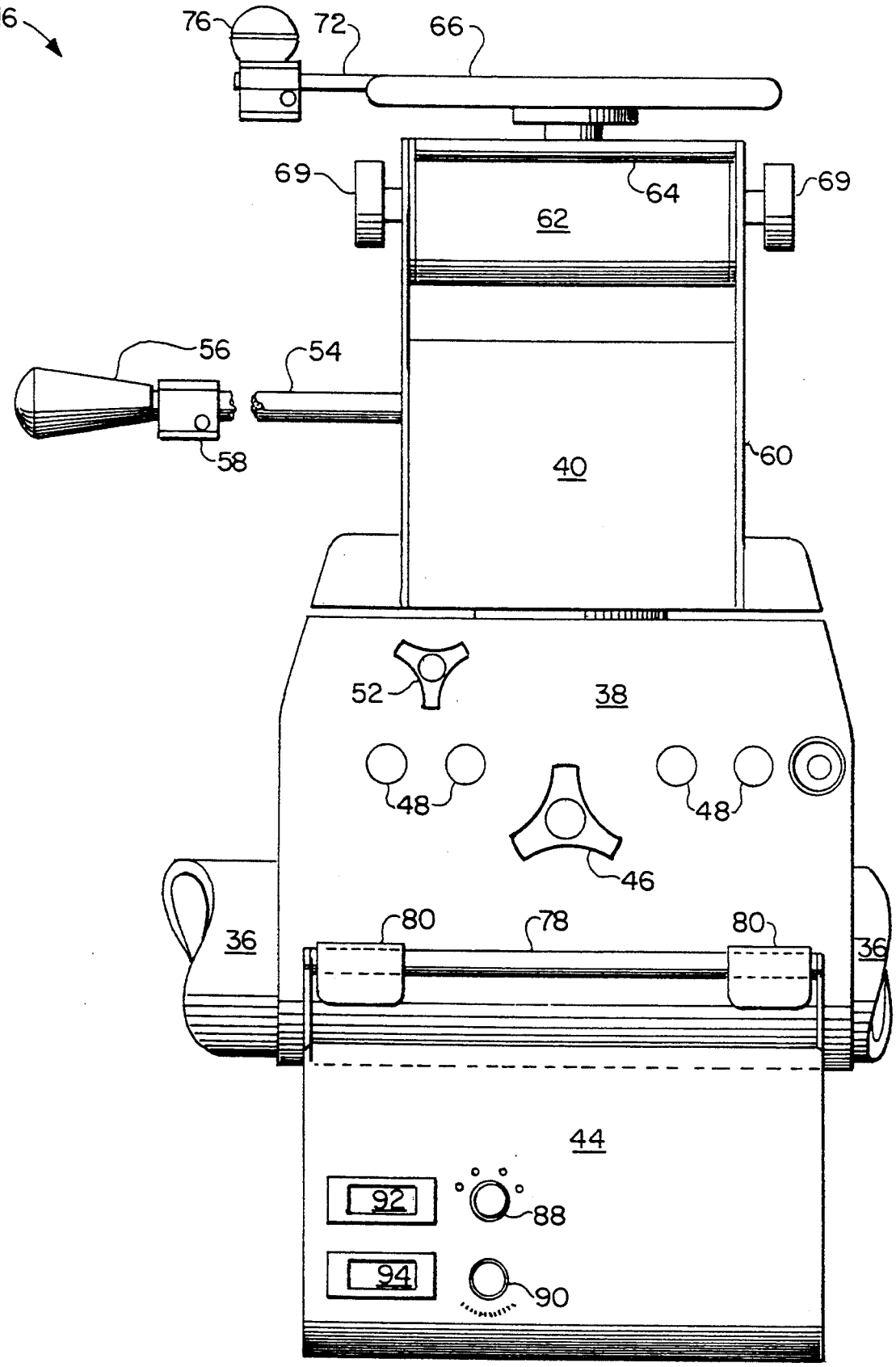
FIG. 3 is a fragmentary top plan view of the disabled driver assessment system.

Referring now to the drawings, the disabled driver measurement system of the present invention is shown therein and comprises a driving simulator, generally designated 12, including hand controls and steering controls for simulating the operation of a motor vehicle. Force adjustment mechanisms provide variable resistance for the steering controls and hand controls. The simulator also provides a structural reference framework for taking anthropometric measurements.

The driving simulator 12 includes a frame 14 and a control assembly 16. The frame 14 is fabricated primarily of aluminum sheet metal and tubing. The frame 14 includes a pair of laterally spaced tracks 18 for accommodating and positioning a wheelchair. The tracks 18 include upturned side flanges 20 which assist in guiding the wheelchair into the proper position. Extending across one end of each track is a stop 22 to prevent the wheelchair from rolling too far forward.

A pair of support columns 24 extend upwardly at an angle from respective tracks 18. The support columns 24 support the main cross tube 36 which in turn supports the control assembly 16. Each support column 24 is constructed in three segments—a lower column segment 26, an intermediate column segment 28, and an upper column segment 30. The lower column segments 26 are permanently secured to the respective tracks 18 and joined with the lower end of the intermediate column segment 28. The upper column segments 30 are secured to the main cross tube 36 and joined with the upper end of the intermediate column segment 28. The intermediate column segments 28 include plastic column inserts 32 projecting from each end which provide a frictional fit with the inside of the upper and lower column segments. The column segments are held together by over-center draw latches 34. In the present embodiment, there are two draw latches 34 at each joint. One of the draw latches 34 is disposed on the inside of the column, and the other is disposed on the outside of the column. The frame 14 can be easily disassembled by disengaging the latches 34, and separating the individual components. The components can then be more easily transported to the test location and reassembled.

The control assembly 16 is removably mounted on the main cross tube 36 of the frame 14. The control assembly 16 includes a shoulder box 38, a neck box 40, a steering unit 42, and a control box 44. The steering unit 42 and control box 44 are easily dismounted for more easily transporting and storing the simulator 12.

The shoulder box 38 comprises a sheet metal housing which is mounted directly on the cross tube 32 by any suitable clamping means. A height adjustment knob 36 on the top of the shoulder box 38 operates the clamping means. By loosening the height adjustment knob 46 slightly, the shoulder box 38 can be rotated around the main cross tube 36 to raise and lower the steering unit 42, or to slide the shoulder box 38 laterally along the main cross tube 36. When the shoulder box 38 is positioned as desired, the adjustment knob 46 can be retightened to secure the shoulder box 38 in the adjusted position. The shoulder box 38 can also be dismounted from the main cross tube 36.

Figure 4:
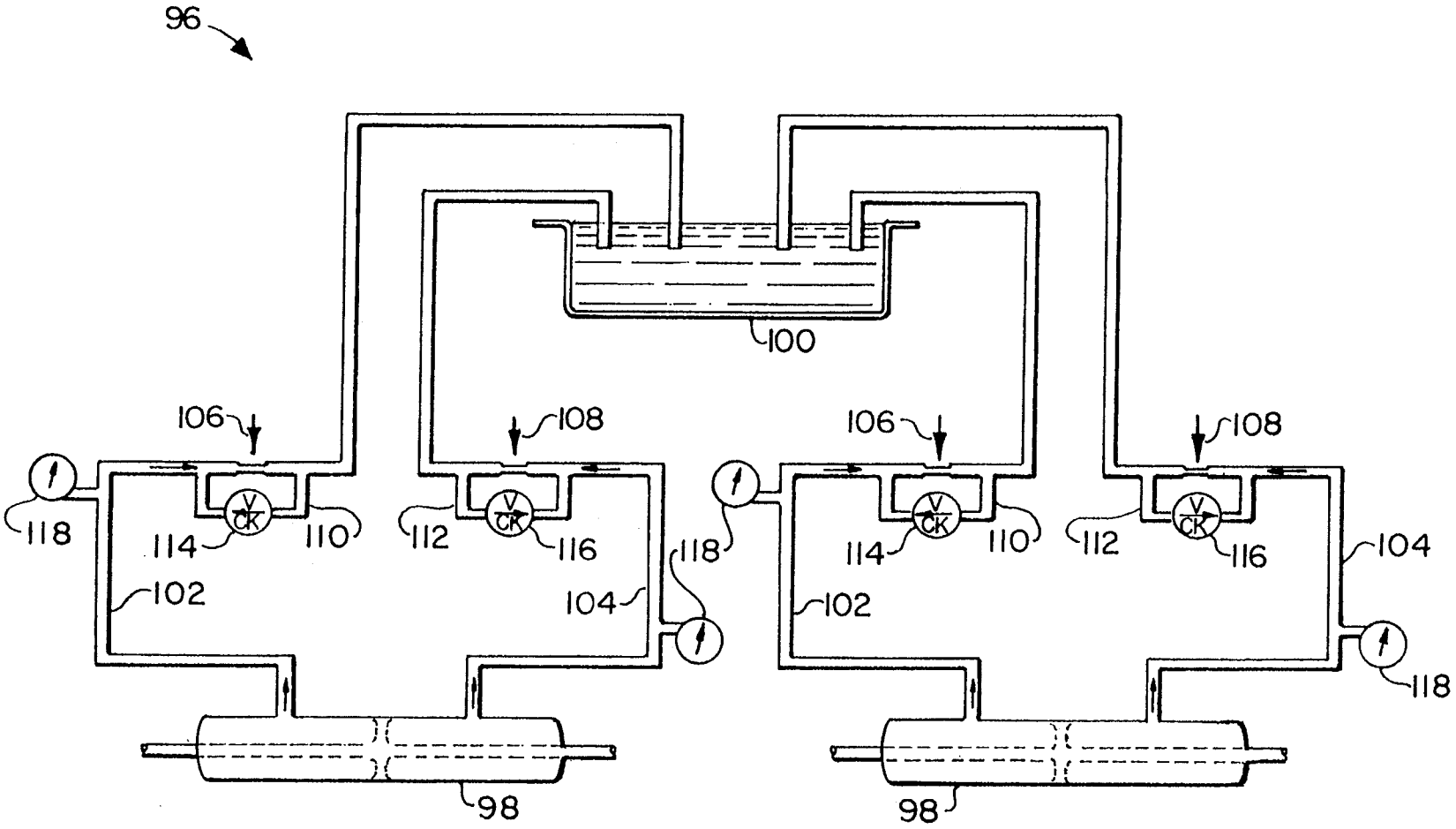
FIG. 4 is a schematic diagram of the hydraulic system for the disabled driver assessment system.

The shoulder box 38 contains a portion of the simulator hydraulic system, including the reservoir and the flow controls. Four flow control knobs 48 are mounted on the top of the shoulder box 38 for operating flow control valves. The hydraulic system is shown in FIG. 4 and will be described in detail below.

The neck box 40 is mounted to the front of the shoulder box 38 and pivots about an axis extending forwardly and rearwardly parallel to the driver's mid-sagittal plane. A hand control lever 54 is mounted underneath the neck box 40 and extends outwardly from the neck box 40. The hand control lever 54 preferably includes replaceable grips 56 which are attached to the hand control lever 54 by means of a quick-connect fitting 58. The hand control lever 54 can be mounted on either side of the neck box 40 since different individuals will use different hands to operate the hand control lever 54. The hand control lever 54 is movable in two directions. The hand control lever 54 can be moved forward and backward in a plane parallel to the floor. The hand control lever 54 can also be moved up and down in a plane perpendicular to the floor.

The hand control lever 54 is mechanically linked by conventional means to a pair of hydraulic cylinders 98 which are mounted within the neck box 40. The hydraulic cylinders 98 provide resistance to the movement of the hand control lever 54. One cylinder provides resistance against forward and backward movement, and one cylinder provides resistance against up and down movement. The amount of resistance supplied by the cylinders can be varied by the turning flow control knobs 48 on the main shoulder box 38 as will be hereinafter described in greater detail.

The steering unit 42 is mounted forward of the neck box 40 on mounting brackets 60. The steering unit 42 includes a head box 62 which contains a magnetic particle brake 132 (FIG. 5) and a steering wheel 66. The head box 62 includes a handle 64 for carrying the head box 62 when the simulator 12 is disassembled. A pair of threaded holes are formed in the sides of the head box 62 to receive mounting screws 68 for mounting the head box 62 on the mounting brackets 60. The mounting screws 68 engage with slots 70 formed on the mounting bracket 60. The mounting screws 68 provide an axis about which the head box 62 can be rotated. Adjustment knobs 69 on the mounting screws 68 tighten against the mounting brackets 60 to secure the head box 62 in a fixed position. By loosening the mounting screws 68, the head box 62 can be rotated about the axis of the mounting screws 68, or the head box 62 can be dismounted.

The steering wheel 66 is mounted on top of the head box 62. The steering wheel 66 is mechanically linked with the magnetic particle brake 132 contained in the head box 62. The magnetic particle brake 132 provides resistance against the turning of the steering wheel 66. An electrical force adjustment mechanism allows the steering resistance force to be varied by the operator. The force adjustment mechanism is described in subsequent portions of this specification.

The steering wheel 66 includes a slide arm 72 which slides in a groove 74 formed in the steering wheel 66. A spinner knob 76 is attached to one end of the slide arm by a quick-connect fitting to enable a plurality of interchangeable spinner knobs 76 to be used. The slide arm 72 slides radially inward and outward relative to the center of the steering wheel 66 so that the effective steering wheel diameter can be varied. A latch (not shown) is provided for locking the slide arm in selected positions. The latch is released by moving a slide button 72A downwardly as shown in FIG. 1. Preferably, the slide arm 72 can be locked in one-inch increments providing an effective steering wheel diameter of between seven to fourteen inches.

The control box 44 is preferably mounted on the back of the shoulder box 38. The control box 44 includes a handle 78 mounted along one edge thereof which is engaged by support clips 80 attached to the shoulder box 38. The control box 44 includes an arcuate surface 82 adjacent the handle 78 which rests against the shoulder box 38. The weight of the control box 44 keeps the handle 78 engaged in the support clips 80 so that no latching mechanism is needed to support the control box 44.

The control box 44 contains most of the electronic components of the simulator apparatus. First and second cords 84 and 86 connect the electric circuitry of the control box 44 with the shoulder box 38 and steering unit 42 respectively. A hand control selector switch 88 and a steering wheel control knob 90 are mounted on the top of the control box 44. Also mounted on the control box are two LCD panel meters 92 and 94 for displaying force measurements. Panel meter 94 displays the steering wheel force, and panel meter 92 displays the hand control force.

Referring now to FIG. 4, the simulator's hydraulic system 96 is shown. The hydraulic system 96 includes force adjustment and measurement means for the hand controls. The hydraulic system 96 includes two double-acting, hydraulic cylinders 98 which are mechanically linked with the hand control lever 54. The hydraulic cylinders 98 are disposed in independent circuits which are connected to a reservoir 100. Only one circuit is described, it being understood that the other circuit is the same as the one described. The circuit includes a first line 102 extending from the reservoir 100 to a first end of the cylinder 98, and a second line 104 extending from the reservoir 100 to the second end of the cylinder 98. Both the first and second lines include a variable flow valve indicated respectively at 106 and 108 which can be adjusted by respective flow control knobs 48 on the shoulder box 38. Bypass lines 110 and 112 bypass each of the flow control valves 106 and 108. Each bypass line includes a one-way check valve indicated respectively at 114 and 116. This arrangement allows the hydraulic fluid to bypass one of the variable flow valves 106 and 108 when the cylinder is moved in one direction, and bypass the other variable flow valve when the cylinder is moved in the opposite direction.

In operation, when the cylinder 98 is moved in a first direction indicated by the arrow in FIG. 4, the hydraulic fluid flows through variable flow valve 106 which provides resistance against the movement of the cylinder. The hydraulic fluid bypasses variable flow valve 108 through the bypass line. When the cylinder moves in the opposite direction, hydraulic fluid flows through variable flow valve 108 and bypasses valve 106. This arrangement allows the resistance to be independently selected for both directions of movement of the cylinder. Preferably, the flow controls should provide a resistance range of approximately 20 to 300 ounces. The resistance force of the hand control is sensed by pressure sensors 118. There are two pressure sensors 118 in each circuit for a total of four. Each sensor 118 provides an output signal corresponding to the force exerted by the driver in one direction. The resistance forces are read directly from the panel meter 92.

Figure 5:
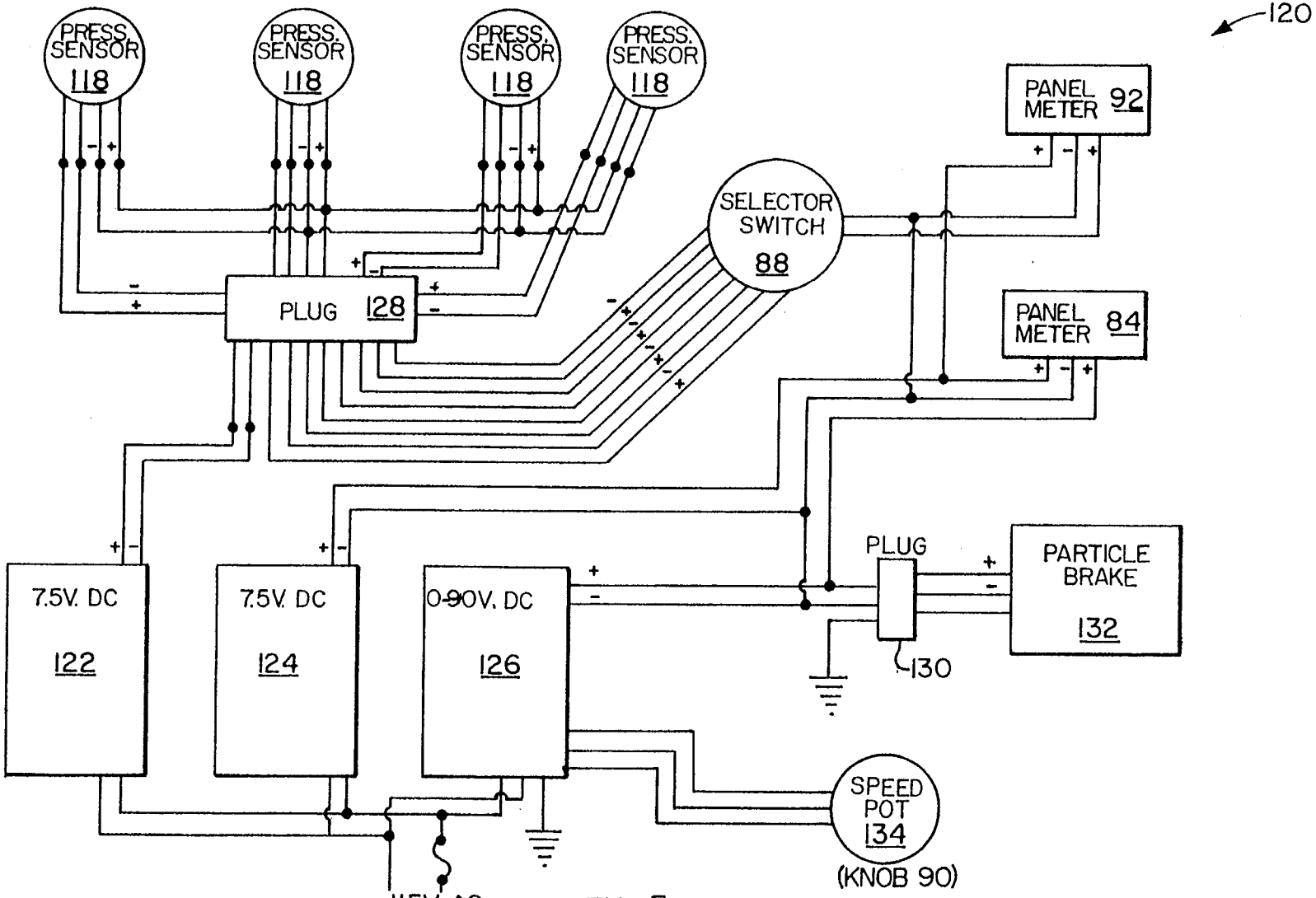
FIG. 5 is an electronic schematic for the disabled driver assessment system.

Referring now to FIG. 5, the electric circuit 120 for the simulator apparatus is shown. The electric circuit includes three independent power supplies 122, 124, and 126. Power supplies 122 and 124 take a 115 volt AC current input and provide a 7.5 volt DC output. Power supply 122 is connected through a plug 128 to pressure sensors 118. Power supply 124 is connected to the panel meters 92 and 94. The third power supply 126 takes a standard 115 volt AC input and provides a variable DC output of 0 to 90 volts. Power supply 126 is connected through a plug 130 to the particle brake 132 in the head box 44. A potentiometer 134 operated by the steering control knob 90 is connected to the power supply 126 to enable the operator to vary the output voltage of the power supply 126. By varying the output voltage, the resistance of the particle brake 132 can be varied. The higher the output voltage, the greater the resistance of the particle brake 132.

The steering resistance force of the particle brake 132 is displayed on panel meter 94. An electric signal is supplied to the panel meter 94 which converts the electric signal into a force measurement which is displayed.

Panel meter 92 displays the hand control force needed for moving the hand control. Because the hand control lever 54 is movable in four directions, a selector switch 88 is provided for selecting between four pressure sensors 118—one corresponding to each direction of movement. The output of the selected pressured sensor 118 is supplied to the panel meter 92. The output signal supplied to the panel meter 92 is used to provide a force measurement which is displayed on the panel meter 92.

The simulator is used to determine the physical requirements of a disabled driver to modify a van or other vehicle to his or her specific needs. The physical requirements are used to develop a specification or "mobility prescription" for modifications needed to customize the vehicle for the driver. The basic procedure is to configure the simulator to a standard configuration and make minor adjustments one function at a time, until functional driving ability is demonstrated. At that point, the system configuration is recorded. The resulting data can be used by a qualified technologist to prepare a specification or "mobility prescription" for modifications needed to customize the vehicle. After the simulator is assembled, the height and angle of the steering wheel 66 is adjusted to conform with a standard vehicle of the type which will be used by the subject, or some other predetermined standard. The steering force resistance is set to represent the average steering force required in a typical power steering system for the vehicle. The steering wheel diameter is set at 13 inches unless another known factor is to be used. A spinner knob 76 is placed on the slide arm 72.

After the setup is complete, an adjustment is made to provide knee clearance for the subject. If the subject is in a wheelchair, the steering wheel 66 will probably need to be raised in order to provide knee clearance. The steering wheel 66 is raised by rotating the shoulder box 38 around the cross tube 36. More particularly, the height adjustment knob 46 on the shoulder box 38 is loosened, the shoulder box 38 is rotated to provide appropriate knee clearance, and the adjustment knob 46 is retightened. Raising the steering wheel 66 will change the steering wheel angle. Accordingly, it will be necessary to readjust the steering wheel angle to its former position each time the steering height is changed. When the steering wheel 66 is raised to provide adequate knee clearance, the steering wheel height measured from the center of the steering wheel to the floor is recorded.

1. Steering Ability Assessment

To determine the subject's steering ability, it should be first determined which hand will most likely be used for steering. Normally, the hand with the best strength and range of motion is used for steering. The subject's ability to steer using the selected hand on the spinner knob 76 is tested. The subject should make several 360° turns in both directions. If the subject is not able to make 360° turns with reasonably dependable stability and reliability, adjustments are made in the following order until reasonable control is established.

First, different spinner knobs 76 are tried to determine which type of interface is most effective for the subject. The interface selected can be reproduced or modified for installation in the vehicle.

Next, the steering resistance is gradually reduced until the subject is able to rotate the steering wheel 66 easily. The resistance is changed by dialing the steering control knob 90 on the control box 44. As the control knob 90 is turned clockwise, more resistance is applied to the steering wheel 66 making it more difficult to rotate. As the control knob 90 is turned counterclockwise, less resistance is applied . The force measurement indicating the steering force in inch-ounces is displayed. To convert this number to ounces, the displayed force is divided by the radius of the steering wheel 66.

The steering force is used to determine the amount of power steering or steering effort reduction needed for the subject. With the steering wheel diameter set at the standard 13 inches, a reading of $48\times6\frac{1}{2}$ inch-ounces would indicate that the client can handle standard power steering in most vehicles. A smaller reading would indicate the need for effort reduction. If a smaller diameter is needed by the client, a proportionally larger force or resistance would be necessary to correlate with standard power steering. If the subject is unable to generate a force greater than 1½ ounces multiplied by the radius of the steering unit, it is likely that the subject should be screened out of driving anything except a unilever or joystick type of system.

The third adjustment made in assessing steering ability, is to reduce the steering wheel diameter . This is accomplished by moving the slide button 72A to a disengaged portion, moving the slide arm 72 radially inward or outward to the desired position, and releasing the slide button 72A to engage the latch. As previously described, the steering wheel diameter can be adjusted between 7 inches and 17 inches in 1-inch increments. This measurement translates directly to the steering wheel diameter required in a vehicle.

The fourth adjustment is to change the angle of the steering wheel. The steering wheel can be adjusted in two ways. First, the steering wheel angle with respect to a horizontal axis parallel to the subject's transverse plane is adjusted by loosening the mounting screws 68 on the sides of the head box 62, rotating the head box 62, and then retightening the mounting screws 68. The steering wheel angle with respect to a horizontal axis perpendicular to the subject's mid-sagittal plane is accomplished by loosening the adjustment knob 52 on the shoulder box 38, rotating the neck box 40, and then retightening the adjustment knob 52.

The final adjustment is to change the height of the steering wheel 66 as previously described. As soon as the ability to steer has been demonstrated, the subject should place the opposite hand on the hand control and retest his steering control. The technician should watch for dependant movements of the hand which might affect acceleration or braking. If dependant movement is observed the subject should try switching steering hands.

At whatever point success is achieved, the technician should stop modifying the system and immediately record all system measurements. Photographs may be taken from the side and front using a camera which imposes a grid over the photograph to record the position.

2. Hand Control Assessment

The hand control lever 54 does not simulate any particular commercial product. However, it does provide a means for measuring strength and making some determination of the range of motion with either hand and in any direction. By this time, the subject's steering hand control has already been determined. Using the subject's other hand, the hand control assessment is conducted as follows.

First, the hand control selector switch 88 is set at "brake" for the appropriate hand. For example, if the subject's right hand is used for the hand controls, the hand control selector switch 88 is set at "brake" for the appropriate hand. Both flow control valves labeled "brake" should be opened. The valve is opened by turning the corresponding flow control knobs 48 counterclockwise. With the flow control valves fully opened, the subject's range of forward/backward motion in a plane parallel to the floor is tested. The range of motion is measured with a tape. A stroke of less than 3 inches will usually indicate the need for a servo or vacuum assisted brake/accelerator control system. While testing the subject's range of motion, different grips 56 should be tried to select the one that is most functional for the subject.

After the range of motion has been tested, the resistance against forward motion of the hand control lever 54 is increased by rotating the flow control knob labeled "brake" for the appropriate hand clockwise. The resistance against forward motion is set at a predetermined amount and the subject's ability to exert this force is tested. This force should be gradually reduced until the subject is successful in pushing the brake handle forward. This force, called the braking force, is then recorded. The subject then attempts to "hold the brake" for at least two minutes. Problems such as fatigue, spasticity, inability or ability to comply should be recorded.

Upon completion of the braking test, the flow control valves labeled "brake" are closed and the hand control selector switch 88 is set at "accelerator" for the appropriate hand. The subject's range of motion in the up-down direction is tested. After recording the results of the range of motion test, the subject's ability to push the hand control lever 54 downward is tested. The resistance against downward motion is increased by turning the flow control knob 48 labeled "accelerator" for the appropriate hand. The resistance should be gradually decreased until the subject is successful in producing a downward motion. The force exerted while moving the hand control lever 54 downward is recorded.

The flow control valves labeled "accelerator" are then closed and the hand control selector switch 88 is set at "brake" for the hand opposite the one being tested. The subject's ability to pull the lever 54 towards the body is then tested using the flow control valve labeled "brake" for the opposite hand. This simulates a push/pull hand control brake. The force exerted while pulling is then recorded.

The force measurements made during the hand control assessment help determine what type of hand controls the client needs. A force reading of less than 48 ounces will usually indicate the need for reduced effort brakes. A reading of less than 32 ounces will usually indicate the need for a servo operated accelerator/-brake control.

3. Driving Space Measurements

When the optimum configuration of the steering wheel and hand control has been determined, the subject is placed in the correct driving position. The subject's position relative to the simulator 12 is then measured and recorded. The following measurements should be made:

1. Overall height measured from the floor.
2. Height of the center of the steering wheel above the floor.
3. Distance from the steering wheel center to the subject's chest.
4. Overall width, rim to rim, of the wheelchair.
5. Overall length, toe to rear of wheel.
6. Foot plate clearance above the floor.
7. Seat height and seat cushion thickness.
8. Distance, if any, of the steering wheel center offset from the mid-sagittal plane.

It is preferred that the system configuration also be recorded photographically. A camera which has been found suitable for use with the present invention is the professional grade Polaroid SE600 camera with a 75 millimeter wide angle lens (not shown). Mounted to the inside of the camera is a square grid with 1-centimeter increments which produces corresponding grid on the photograph. This grid assists the technician in accurately measuring the client.

When taking photographs, the height of the lens is set at 37 inches, and the distance from the centerline of the client is set at 8 feet. The photograph can be enlarged 188% photographically or by a copier for use in measuring with a ruler. At 188% and using the 8 feet from the centerline of the client, the grid is divided into 1 foot blocks.

The present invention enables a trained technician to test the functional driving ability of a disabled driver and provides a structural reference framework for taking anthropometric measurements. This information can then be used to provide a more accurate specification detailing the modifications and adaptive driving equipment needed to customize a vehicle for a particular driver. Further, the modular driver measurement system can be easily disassembled and transported to the subject's home when transportation of the disabled person is inconvenient.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A driver assessment system for assessing the driving ability of a disabled driver in order to enable prescribing structural modifications and adaptive driving equipment to customize a vehicle for said disabled driver comprising:

a frame adapted to receive a driver seated in a wheelchair;

a steering assembly mounted on the frame comprising a steering wheel rotatable by the driver, said steering wheel having a height, an angle, a position, and a diameter, means for adjusting the height of the steering wheel, means for adjusting the angle of the steering wheel plane, means for laterally adjusting the position of the steering wheel relative to the driver's mid-sagittal plane, and means for adjusting the diameter of the steering wheel;

a first force measuring means operatively connected with the steering wheel for measuring a steering force applied by the driver;

a hand control mounted on the frame and at least movable by the driver forward and backward and up and down;

a second force measuring means operatively connected with the hand control for measuring a force applied by the driver to the hand control; and track means for positioning said wheelchair with respect to said assessment system thereby providing a reference for assessing structural modifications.

2. A driver assessment system according to claim 1 wherein the first force measuring means includes means for applying a steering resistance force to the steering wheel, and means for selectively varying the steering resistance force.

3. A driver assessment system according to claim 2 wherein the means for applying a steering resistance force to the steering wheel comprises a magnetic particle brake.

4. A driver assessment system according to claim 2 further including display means for displaying the steering resistance force.

5. A driver assessment system according to claim 1 wherein the hand control includes a hand control lever and a plurality of interchangeable grips.

6. A driver assessment system according to claim 1 wherein the second force measuring means includes means for applying a hand control resistance force to the hand control, and means for selectively varying the hand control resistance force.

7. A driver assessment system according to claim 6 wherein the means for applying a hand control resistance force to the hand control includes a hydraulic cylinder mechanically linked with the hand control.

8. A driver assessment system according to claim 7 wherein the means for selectively varying the hand control resistance force includes a variable flow control valve connected in series with the hydraulic cylinder.

9. A driver assessment system according to claim 6 further including display means for displaying the hand control resistance force.

10. A driver assessment system for assessing the driving ability of a disabled driver in order to enable prescribing structural modifications and adaptive driving equipment to customize a vehicle for said disabled driver comprising:

a frame adapted to receive a driver seated in a wheelchair;

a steering assembly mounted on the frame comprising a steering wheel rotatable by the driver, said steering wheel having a height, an angle, a position, and a diameter, means for adjusting the height of the steering wheel, means for adjusting the angle of the steering wheel plane, means for laterally adjusting the position of the steering wheel relative to the driver's mid-sagittal plane, and means for adjusting the diameter of the steering wheel;

a first force measuring means operatively connected with the steering wheel for measuring a steering force applied by the driver;

a hand control mounted on the frame and at least movable by the driver forward and backward and up and down;

a second force measuring means operatively connected with the hand control for measuring a force applied by the driver to the hand control; and track means having stop means, for stopping the wheelchair said track means being for positioning said wheelchair with respect to said assessment system thereby providing a reference for assessing structural modifications.

11. A driver assessment system for assessing a disabled driver in order to enable prescribing structural modifications and adaptive driving equipment to customize a vehicle for said disabled driver comprising:

a frame adapted to receive a driver seated in a wheelchair;

a steering assembly mounted on the frame comprising a steering wheel rotatable by the driver, said steering wheel having a height, an angle, a position, and a diameter, means for adjusting the height of the steering wheel, means for adjusting the angle of the steering wheel plane, means for laterally adjusting the position of the steering wheel relative to the driver's mid-sagittal plane, and means for adjusting the diameter of the steering wheel;

a first force measuring means operatively connected with the steering wheel for measuring a steering force applied by the driver;

a hand control mounted on the frame and at least movable by the driver forward and backward and up and down; and a second force measuring means operatively connected with the hand control for measuring a force applied by the driver to the hand control;

wherein said frame is supported by two elongate and spaced-apart tracks, said tracks each comprising a bottom surface having an end and lengthwise sides, and having upturned side surfaces at one end and at both opposing lengthwise sides thereof, said tracks positioning said wheelchair with respect to said assessment system thereby providing a reference for assessing structural modifications has been inserted after "reference".

12. A driver assessment system for assessing a disabled driver in order to enable prescribing structural modifications and adaptive driving equipment to customize a vehicle for said disabled driver comprising:

a frame adapted to receive a driver seated in a wheelchair;

a steering assembly mounted on the frame comprising a steering wheel rotatable by the driver, said steering wheel having a height, an angle, a position, and a diameter, means for adjusting the height of the steering wheel, means for adjusting the angle of the steering wheel plane, means for laterally adjusting the position of the steering wheel relative to the driver's mid-sagittal plane, and means for adjusting the diameter of the steering wheel;

a first force measuring means operatively connected with the steering wheel for measuring a steering force applied by the driver;

a hand control mounted on the frame and at least movable by the driver forward and backward and up and down; and a second force measuring means operatively connected with the hand control for measuring a force applied by the driver to the hand control;

wherein the steering wheel includes a plurality of interchangeable spinner knobs, to test the driver's ability to steer the steering wheel.

13. A driver assessment system for assessing a disabled driver in order to enable prescribing structural modifications and adaptive driving equipment to customize a vehicle for said disabled driver comprising:

a frame adapted to receive a driver seated in a wheelchair;

control means mounted on the frame and operable by the driver wherein the control means comprises a steering wheel, and a hand control;

force measurement means operatively connected with said control means for measuring a force extended by the driver on the control means; and means for adjusting a spatial arrangement of the control means;

wherein said frame is supported by two elongate and spaced-apart tracks, said tracks each comprising a bottom surface having an end and lengthwise sides, and having upturned side surfaces at one end and at both opposing lengthwise sides thereof, said tracks positioning said wheelchair with respect to said assessment system thereby providing a reference for assessing structural modifications.

14. A driver assessment system according to claim 13 wherein the force measurement means includes means for applying a resistance force to the control means, and means for varying the resistance force.

15. A driver assessment system according to claim 14 further including display means for displaying the resistance force.

* * * * *